United States Patent [19]

Hellberg

[11] 4,442,551

[45] Apr. 17, 1984

[54] ADAPTER FOR A PROTECTIVE HELMET

[75] Inventor: Arne Hellberg, Gråbo, Sweden

[73] Assignee: Hellberg Protection AB, Lerum, Sweden

[21] Appl. No.: 452,034

[22] Filed: Dec. 22, 1982

[51] Int. Cl.[3] ..... A42B 1/06; A42B 3/00

[52] U.S. Cl. ..... 2/10; 2/424

[58] Field of Search ..... 2/424, 422, 9, 10, 6, 2/8, 423, 453

[56] References Cited

U.S. PATENT DOCUMENTS 2,578,171 12/1951 Bub ..... 2/8

4,222,123 9/1980 Hellberg ..... 2/10

*Primary Examiner*—Peter P. Nerbun

*Attorney, Agent, or Firm*—Holman & Stern

[57] ABSTRACT

An adapter, for adapting an accessory fitting for various size pockets at the margin of protective helmets, has two tapering end walls and front and rear side walls, extending from opposite ends of the end walls, overlapping each other about midway thereof. The front wall is provided with an opening for receiving a projection of the fitting, which normally presses against the inner side of an outer wall of the pocket. The front wall is, adajcent to the opening, provided with a ridge, locally increasing the wall thickness.

5 Claims, 6 Drawing Figures

ADAPTER FOR A PROTECTIVE HELMET

BACKGROUND OF THE INVENTION

1. Field of the Invention

This invention relates to protective helmets and fitting adaptors for accessory fittings removably attachable to the helmets in slot type pockets on the lower margin of the helmets.

2. Description of the Prior Art

Protective helmets used by workmen are usually adapted to carry various kinds of additional protective equipment, such as ear muffs, face shields and the like. To facilitate an easy mounting and dismounting of such equipment, the helmet is provided with slots or pockets in its lower margin, about above the ears of the wearer of the helmet.

The size of these pockets varies somewhat from manufacturer to manufacturer, and as it is frequently necessary to swing for instance the ear muffs into and out of a position covering the ears, it is essential that the fittings holding the equipment is safely retained in the pockets. With some face shields it is important that the shield fits snugly against the peak of the helmet, and the fittings can then not be allowed to slide backwards and forwards in the pockets.

The additional equipment is often supplied by different manufacturers, and in order to be able to apply their equipment to helmets having different pocket sizes such additional equipment has to be delivered with fittings of different sizes. That will increase manufacturing and stock-keeping costs, and may cause confusion.

The object of the present invention is to propose an adapter, which will safely hold a "small" fitting in a bigger pocket.

SUMMARY OF THE INVENTION

An adapter according to the invention is formed as a sleeve-shaped member having two tapering end walls, as well as front and rear walls interconnecting the same. The rear wall extends from the broader ends of the tapering end walls to about midway thereof, while the front wall extends from the pointed ends of the tapering end walls so it overlaps the rear wall. The front wall has an opening for the reception of a projection at the fitting.

The front wall is, between the opening and its margin at the pointed end of the end walls, provided with a ridge, locally increasing the thickness of the front wall.

DESCRIPTION OF A PREFERRED EMBODIMENT

Figure 1:
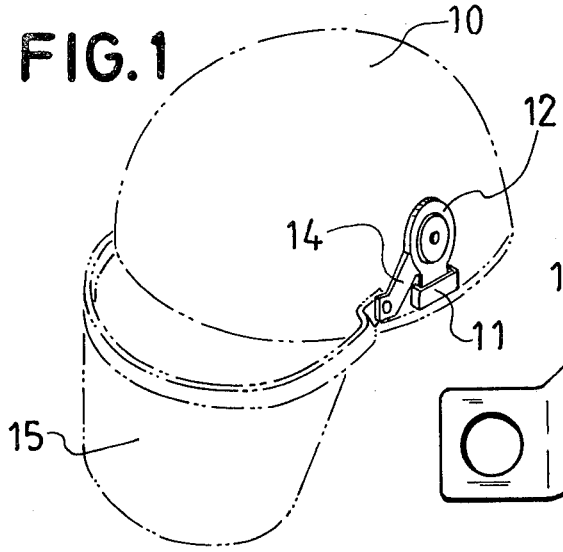
FIG. 1 is a schematic perspective view showing a protective helmet and one of the fittings according to the invention carrying a face shield.
Figure 2:
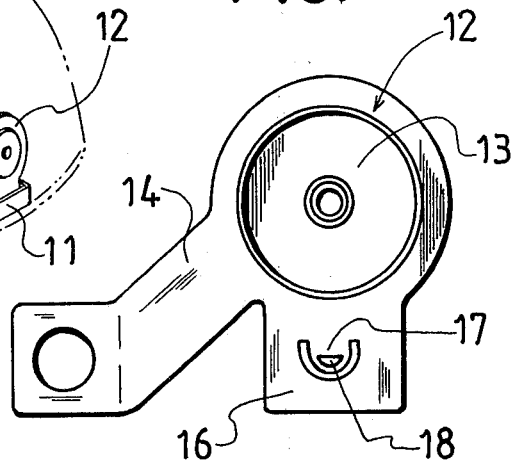
FIG. 2 is an elevational view showing the fitting removed from the helmet.
Figure 3:
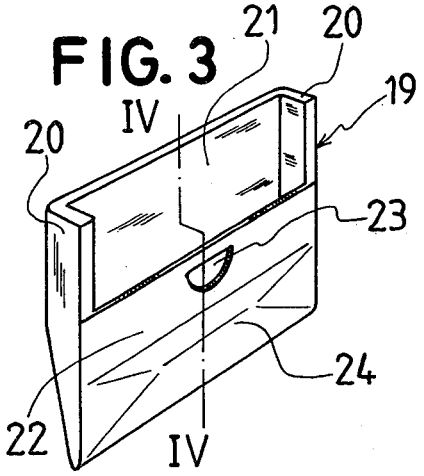
FIG. 3 is a perspective view of the adapter.
Figure 4:
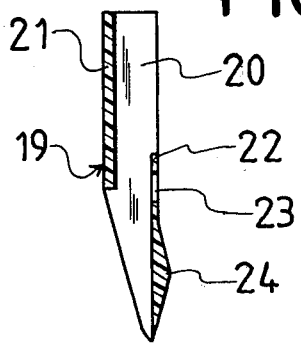
FIG. 4 is a cross-sectional view through the adapter along line IV—IV in FIG. 3.
Figure 5:
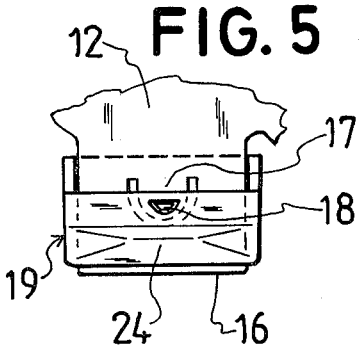
FIG. 5 is a side elevational view of part of the fitting with the adapter mounted thereon.

FIG. 1 shows a helmet 10 of arbitrary known design, having a pocket 11 at its lower margin, about above each ear of the wearer of the helmet. A fitting 12 of a type shown in U.S. De. Pat. No. 264 141 is mounted in each pocket. Each fitting 12 has a central portion 13, suited for carrying an ear muff (not shown), as well as a forwardly directed arm 14 for carrying one end of a face shield, or visor 15.

The fitting further includes a leaf 16 adapted to be introduced into the pocket 11. The leaf is (see FIG. 6) slightly bent in relation to the central portion 13 to apply a certain pressure upon the internal walls of the pocket, and is provided with a resilient tongue 17, having a projection 18. This will be pressed against the outward wall of the pocket.

The dimensions of the leaf are selected so as to make possible a safe retention in a "small", or normal pocket. Some manufacturers make the pockets slightly broader and wider than the more common size, which means that a normal fitting mounted therein will not be held firmly.

To that end an adapter 19 is used to enlarge the dimensions of the leaf 16. The adapter is made from a resilient, or in any case not fully rigid material, and comprises two tapering end walls 20. The thickness of these end walls is selected so as to suitably increase the breadth of the leaf 16.

The end walls 20 are interconnected by a rear wall 21 and a front wall 22. The rear wall 21 extends from the broader, upper, ends of the end walls, to about midway thereof. The front wall, which in use is turned outwards, away from the helmet, extends from the pointed ends of the end walls, upwards to about midway thereof. The rear and the front walls overlap each other to provide a satisfactory stability in the adapter.

The front wall 20 is, adjacent to its upper margin, provided with an opening 23, suited to receive the projection 18 at the leaf 16 of the fitting 12. The engagement between the projection 18 and the opening 23 ensures that the adapter does not unintentionally slide off the leaf when the fitting is removed from the pocket.

Figure 6:
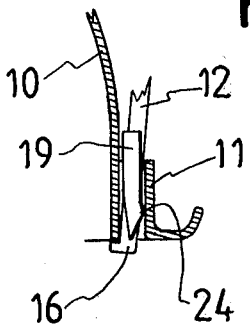
FIG. 6 is a cross-sectional view at the margin of the helmet with the fitting and adapter introduced in the pocket.

Some pockets have a closed bottom, while others are open downwards, as shown in FIG. 6. In the latter case the leaf is preferably provided with an inwardly directed ledge, adapted to snap in below the lower margin of the inward wall of the pocket.

Below the opening 23 the wall has an outwardly directed ridge 24, which locally increases the thickness of the front wall, and ensures a satisfactory pressure against the inner sides of the walls of the pocket.

The adapter is comparatively cheap to manufacture, and can easily be slipped upon the leaf 16. By selecting the thickness of the walls a "small" fitting leaf will be safely retained also in rather large pockets.

What I claim is:

1. An adapter for removable attachment to an arm of a fitting for mounting the fitting in a pocket at the margin of a protective helmet, said fitting arm having a sidewardly directed projection extending from a resilient tongue, said adapter comprising a sleeve-shaped member having two at least partly tapering end walls, and front and rear walls interconnecting said end walls, said rear wall extending from the wider end of said tapering end walls to approximately midway thereof, said front wall extending from the narrower ends of said tapering end walls to about midway thereof, and said front wall having an opening for the reception of the projection of said fitting.

2. The adapter according to claim 1, wherein said front wall, between said opening and its margin at the narrower end of said end walls, is provided with a ridge, locally increasing the thickness of said front wall.

3. An adapter as claimed in claim 2 wherein said tapering end walls comprise a substantially rectangular shaped upper portion and a triangular shaped lower portion, said tapering extending rearwardly from the lower ends of the end walls to approximately the lower edge of said rear wall.

4. An adapter as claimed in claim 3 wherein said front and rear walls are substantially rectangular planar members.

5. An adapter as claimed in claim 4 wherein said ridge extends outwardly from said front wall.

* * * * *